US008682490B2

(12) United States Patent
Yamada et al.

(10) Patent No.: US 8,682,490 B2
(45) Date of Patent: Mar. 25, 2014

(54) PROGRAM, CONTROLLER, AND BOILER SYSTEM

(75) Inventors: Kazuya Yamada, Matsuyama (JP); Koji Miura, Matsuyama (JP)

(73) Assignee: Miura Co., Ltd., Matsuyama-shi (JP)

( * ) Notice: Subject to any disclaimer, the term of this patent is extended or adjusted under 35 U.S.C. 154(b) by 290 days.

(21) Appl. No.: 13/071,965

(22) Filed: Mar. 25, 2011

(65) Prior Publication Data

US 2011/0238216 A1 Sep. 29, 2011

(30) Foreign Application Priority Data

Mar. 29, 2010 (JP) ..... 2010-074057

(51) Int. Cl.
*G05D 23/00* (2006.01)

(52) U.S. Cl.
USPC ..... 700/274; 422/62; 436/55

(58) Field of Classification Search
None
See application file for complete search history.

(56) References Cited

U.S. PATENT DOCUMENTS 4,482,814 A * 11/1984 Daniels ..... 290/40 B
4,860,696 A * 8/1989 Fujita ..... 122/448.3

FOREIGN PATENT DOCUMENTS

JP 8-49803 2/1996
JP 2005-43001 2/2005

OTHER PUBLICATIONS

Machine Translation of JP-2005043001-A.*

* cited by examiner

*Primary Examiner* — Jill Warden
(74) *Attorney, Agent, or Firm* — Fox Rothschild LLP

(57) ABSTRACT

A storage medium stores a program which, when executed by a controller, causes the controller to control a boiler group including boilers each of which has a plurality of stepwise combustion positions. The program includes the steps of calculating a number of a presently combustion shiftable boilers, a number of their combustion positions, or a gross evaporation quantity, calculating a deviation quantity between a set physical quantity and a present time physical quantity, calculating a ratio between the deviation quantity and a control width that corresponding to the set physical quantity, and calculating the combustion subject boilers and their combustion positions based on the number of the combustion shiftable boilers, the number of their combustion positions, or the gross evaporation quantity and the ratio.

12 Claims, 7 Drawing Sheets

PROGRAM, CONTROLLER, AND BOILER SYSTEM

This application claims priority to Japanese patent Application No. 2010-074057 filed Mar. 29, 2010, the entire contents of which being hereby incorporated herein by reference.

BACKGROUND OF THE INVENTION

1. Field of the Invention

The present invention relates to a program, a controller, and a boiler system that are configured to control a boiler group including boilers each of which has a plurality of stepwise combustion positions.

2. Description of the Related Art

Conventionally, in the case of controlling the combustion in a boiler group including a plurality of boilers, technologies have been disclosed that are related to the control of the boiler group in which a combustion quantity is calculated based on a steam pressure to determine the number of the boilers subject to combustion based on results of the calculations.

In those boiler systems, the number of the combustion subject boilers (combustion positions) is set corresponding to the header pressure so that combustion may occur at a predetermined number of the combustion positions in accordance with the priority sequence numbers according to the present time header pressure.

In such a control method, as shown in, for example, FIG. 9A, in the case of operating four combustion shiftable boilers (Nos. 1 to 4) and one preliminary can (No. 5) in a boiler group including five three-position boilers (Nos. 1 to 5, having a differential evaporation quantity of 500 (kg/h)) at each combustion position at a set pressure of 1.0 (MPa) and an allowable pressure width of 0.2 (MPa), each combustion position is allotted 0.025 (MPa). Therefore, if the present time pressure is 0.87 (MPa), the six combustion positions are subject to combustion. It is to be noted that in FIGS. 9A, 9B, and 9C, a hatched frame denotes the combustion position which is provided with a combustion output.

However, in a case where the number of preliminary cans (Nos. 4 and 5) is increased to two owing to, for example, a failure, if a pressure deviation is equal to or less than 0.15 (MPa), although the combustion quantity can be controlled stepwise all over the allowable pressure width, the present time pressure lowers to 0.825 (4 Pa) so that the pressure deviation may go beyond 0.15 (MPa) up to 0.175 (MPa), whereupon combustion needs to occur at seven combustion positions, so that one combustion position lacks because combustion can occur only in the three boilers as against seven combustion positions where combustion needs to occur as shown in FIG. 9B, thereby making it difficult to conduct control appropriately. (A shaded portion in FIG. 9B denotes a lacking position.)

On the other hand, in a case where the preliminary can (No. 5 boiler) has shifted to a combustion shiftable boiler to increase the number of combustion shiftable boilers to five, if the present time pressure variations are within the range of the allowable pressure width of 0.20 (MPa), for example, the pressure deviation of 0.15 (MPa), combustion is output only to six combustion positions as shown in FIG. 9C, so that the No. 5 boiler is put into essentially the same state as the preliminary can unless the present time pressure variations fall outside the allowable pressure width of 0.20 (MPa).

Accordingly, loads are concentrated to the No. 1 through No. 4 boilers, to make it difficult to carry out effective operations by means of distribution of the loads.

To solve the problem, there are technological demands for operating a boiler group effectively even if the number of the combustion shiftable (operational) boilers varies.

SUMMARY OF THE INVENTION

In view of the above, the present invention has been developed, and it is an object of the present invention to provide a program, a controller, and a boiler system that can effectively operate a boiler group including a plurality of boilers even if the number of the combustion shiftable (operational) boilers varies in control of the boiler group.

To solve those problems, the present invention provides the following means.

In accordance with a first aspect of the present invention, there is provided a program for controlling a boiler group including boilers each of which has a plurality of stepwise combustion positions, including: calculating the number of the presently combustion shiftable boilers, the number of their combustion positions, or a gross evaporation quantity; calculating a deviation quantity between a set physical quantity and a present time physical quantity; calculating a ratio between the deviation quantity and a control width that corresponds to the set physical quantity; and calculating the combustion subject boilers and their combustion positions based on the number of the combustion shiftable boilers, the number of their combustion positions, or the gross evaporation quantity and the ratio.

In accordance with a sixth aspect of the present invention, there is provided a controller including the program of any one of the first to fifth aspects.

In accordance with a seventh aspect of the present invention, there is provided a boiler system including the controller according to the sixth aspect.

In accordance with the program, controller, and boiler system according to the present invention, based on the number of the presently combustion shiftable boilers, the number of their combustion positions, or a gross evaporation quantity and the ratio with respect to the pressure control width calculated from the set physical quantity and the present time physical quantity, the combustion boilers and their combustion positions are controlled, so that even if the number of the combustion shiftable boilers in the boiler group varies, the allowable control width is controlled over the combustion shiftable boilers and the combustion positions as a whole. It is therefore possible to operate the boiler group efficiently.

In accordance with a second aspect of the present invention, there is provided the program according to the first aspect, including: calculating the number of the presently combustion shiftable boilers or the number of their combustion positions; calculating a pressure deviation between a set pressure and a present time pressure; calculating a ratio of the pressure deviation with respect to a pressure control allowable width by dividing the pressure deviation by the pressure control allowable width, to; and calculating the combustion subject boilers and their combustion positions by multiplying the ratio and the number of combustion shiftable positions.

In accordance with the program according to the present invention, the number of the presently combustion shiftable boilers or the number of their combustion positions is calculated, the ratio of the pressure deviation with respect to the pressure control allowable width (hereinafter referred to as control pressure width in some cases) is calculated from the pressure deviation between the set pressure and the present time pressure, and based on the results the combustion subject boilers and their combustion positions are calculated, so that the control pressure width can be controlled over all of the combustion shiftable boilers. Resultantly, the boiler group can be operated efficiently.

In accordance with a third aspect of the present invention, there is provided the program according to the second aspect, including: calculating the number of the combustion positions of the operational boilers to which positions a combustion instruction is output, the number of the combustion positions required at the time of drop in pressure, and the number of the combustion positions required at the time of rise in pressure; when the combustion positions to which the combustion instruction is output<the number of combustion positions required at the time of drop in pressure, outputting a combustion signal to the combustion position of any one of the operational boilers; when the combustion positions to which the combustion instruction is output>the number of combustion positions required at the time of rise in pressure, outputting a standby signal to the combustion position of any one of the operational boilers; and when the number of combustion positions required at the time of rise in pressure≥the number of the combustion positions to which the combustion instruction is output≥the number of combustion positions required at the time of drop in pressure, maintaining the present combustion state.

In accordance with the program according to the present invention, without detecting a rise or drop in pressure, it is possible to easily calculate the number of the combustion positions subject to combustion and also operate the boiler group efficiently.

In accordance with a fourth aspect of the present invention, there is provided the program according to the first aspect, including: calculating the gross evaporation quantity at the combustion positions that can shift in combustion at the present time; calculating a pressure deviation between a set pressure and a present time pressure; calculating a ratio of the pressure deviation with respect to a pressure control allowable width by dividing the pressure deviation by the pressure control allowable width; calculating a required evaporation quantity by multiplying the ratio and the gross evaporation quantity; and calculating the boilers subject to combustion and their combustion positions.

In accordance with the program according to the present invention, the ratio of the pressure deviation with respect to the control pressure width is calculated from the pressure deviation between the set pressure and the present time pressure and then multiplied by the gross evaporation quantity to calculate a required evaporation quantity, based on which results the combustion subject boilers and their combustion positions are calculated, so that the control pressure width can be controlled over all of the combustion shiftable boilers. Resultantly, the boiler group can be operated efficiently.

In accordance with a fifth aspect of the present invention, there is provided the program according to the fourth aspect, including: comparing the required evaporation quantity and the gross evaporation quantity at the combustion positions to which the combustion instruction is output; when the required evaporation quantity>the gross evaporation quantity at the combustion positions to which the combustion instruction is output at the time of drop in pressure, the combustion signal is output to the combustion position that corresponds to the evaporation quantity of (the required evaporation quantity−the gross evaporation quantity at the combustion positions to which the combustion instruction is output); and when the required evaporation quantity<the gross evaporation quantity at the combustion positions to which the combustion instruction is output at the time of rise in pressure, the standby signal is output to the combustion position that corresponds to the evaporation quantity of (the gross evaporation quantity at the combustion positions to which the combustion instruction is output−the required evaporation quantity).

In accordance with the program according to the present invention, the combustion signal or the standby signal is output to the combustion position having a differential evaporation quantity that corresponds to (required evaporation quantity−present time evaporation quantity), so that an evaporation quantity close to the required evaporation quantity can be secured efficiently. As a result, the boiler group can be operated efficiently.

In the present specification, "to output the combustion signal to the combustion positions that corresponds to an evaporation quantity equal to (the required evaporation quantity−the gross evaporation quantities at the combustion positions to which the combustion instruction is output)" or "to output the standby signal to the combustion positions that corresponds to an evaporation quantity equal to (the gross evaporation quantity at the combustion positions to which the combustion instruction is output−the required evaporation quantity)" respectively refers to instruction combusting or waiting to bring the total sum of the evaporation quantities at the combustion positions to which the combustion instruction is output close to the required evaporation quantity and the corresponding combustion position refers to, in a case where combusting or waiting is instructed:

(1) a combustion position where the gross evaporation quantity gets closer to the required evaporation quantity than the present time one irrespective of whether the range is set or not;

(2) a combustion position where the gross evaporation quantity falls in a predetermined range of the required evaporation quantity;

(3) a combustion position where a relationship of the gross evaporation quantity≥the required evaporation quantity is established and the gross evaporation quantity is a minimum or falls in the predetermined range; or (4) a combustion position where a relationship of the gross evaporation quantity≤the required evaporation quantity is established and the gross evaporation quantity is a maximum or falls in the predetermined range.

In the present specification, a differential evaporation quantity refers to an evaporation quantity increased when a boiler is shifted to a combustion position one step higher, that is, a difference between an evaporation quantity at the post-shift combustion position and that at the pre-shift combustion stopped position (or combustion position), and an evaporation quantity increased when the shift is made by one step higher to the N-th combustion position (N is one or larger integer) refers to "a differential evaporation quantity at the N-th combustion position" or "the N-th differential evaporation quantity", for example, an evaporation quantity increased when the shift is made from the combustion stopped position to the first combustion position refers to "a differential evaporation quantity at the first combustion position" or "the first differential evaporation quantity" and an evaporation quantity increased when the shift is made from the first combustion position to the second combustion position refers to "a differential evaporation quantity at the second combustion position" or "the second differential evaporation quantity".

In accordance with the program, controller, and boiler system according to the present invention, in control of a boiler group including a plurality of boilers, even if the number of the combustion shiftable boilers varies, the boiler group can be operated efficiently.

DETAILED DESCRIPTION OF THE PREFERRED EMBODIMENTS

The following will describe a first embodiment of the present invention with reference to FIGS. 1 to 4C.

Figure 1:
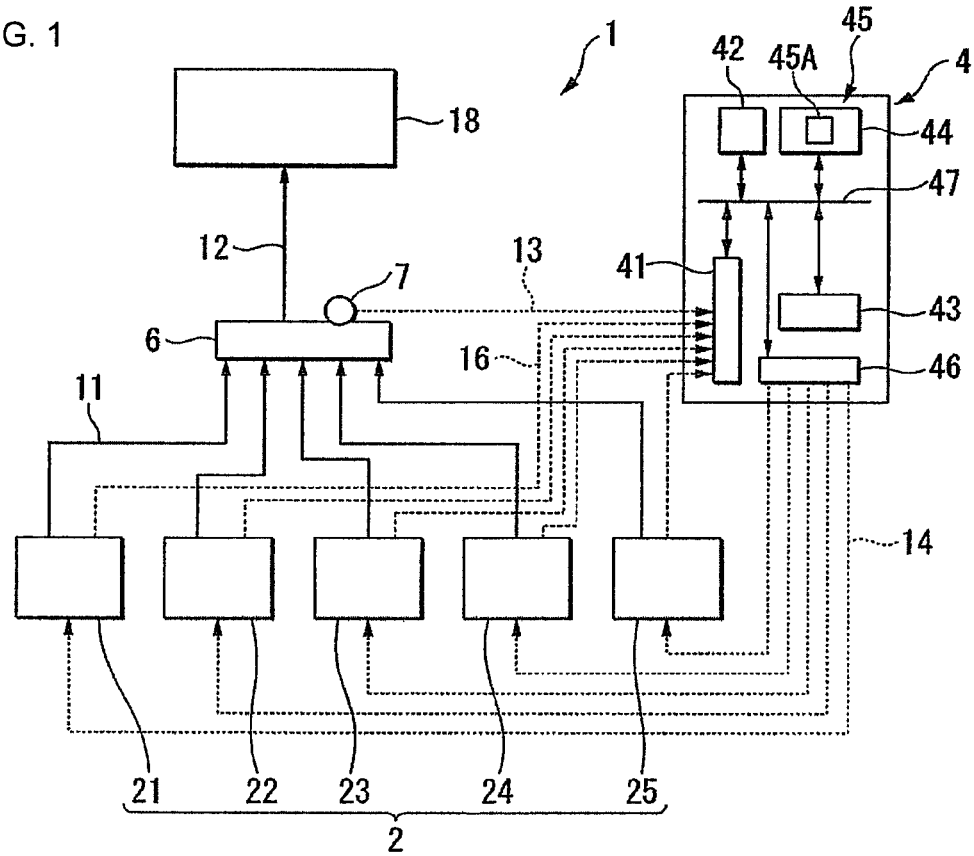
FIG. 1 is a diagram showing an outline of a boiler system according to a first embodiment of the present invention.

FIG. 1 is shows the first embodiment of a boiler system according to the present invention, in which numeral 1 denotes the boiler system.

The boiler system 1 includes a boiler group 2 including a plurality of boilers, a control unit (controller) 4, a steam header 6, and a pressure sensor 7 mounted on the steam header 6, to supply a steam utilizing installation 18 with steam generated in the boiler group 2.

In the present embodiment, the boiler group 2 includes, for example, five steam boilers of a first boiler 21, a second boiler 22, a third boiler 23, a fourth boiler 24, and a fifth boiler 25.

In the present embodiment, in place of a desired load, a pressure (physical quantity) of steam in the steam header 6 detected by the pressure sensor 7 is used, based on which pressure, the quantity of steam is calculated which corresponds to the quantity of steam dissipated in the steam utilizing installation 18.

The steam header 6 is connected to the first boiler 21 through the fifth boiler 25 via a steam pipe 11 and also connected to the steam utilizing installation 18 via a steam pipe 12, to gather steam generated in the boiler group 2 and supply it to the steam utilizing installation 18 by adjusting a pressure difference and pressure variations among the boilers.

Figure 2:
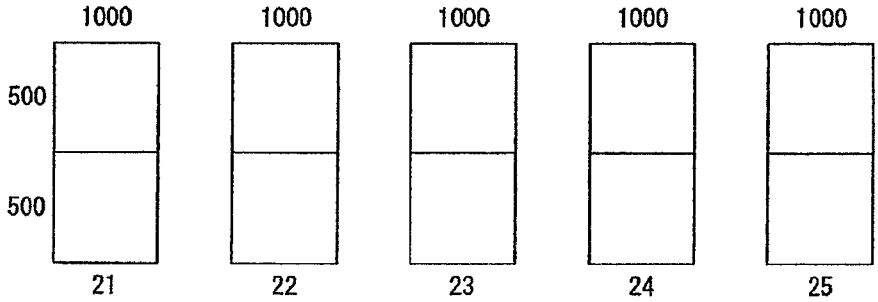
FIG. 2 is an explanatory view showing an outline of boilers in the boiler group according to the first embodiment.

The boilers 21 through 25 of the boiler group 2 are each, for example, a three-position control boiler as shown in FIG. 2 and can be controlled in combustion in a combustion stopped state (which corresponds to a combustion stopped position), a low combustion state assumed to be a bottom combustion position (which corresponds to a first combustion position), and a high combustion state (which corresponds to a second combustion position).

Further, the boilers 21 through 25 are assumed to have a first differential evaporation quantity of 500 (kg/h), a second differential evaporation quantity of 500 (kg/h), and a rated evaporation quantity of 1000 (kg/h).

Further, the boilers 21 through 25 are arranged to notify the control unit 4 of whether their respective combustion positions are combustion shiftable.

Further, the boilers 21 through 25 are capable of controlling each of the combustion positions or the combustion stopped position corresponding to a desired load; for example, if the pressure in the steam header 6 rises, the evaporation quantity is decreased, and if the pressure drops, the evaporation quantity is increased.

The control unit 4 includes an input unit 41, a memory 42, an operation unit 43, a hard disk 44, an output unit 46, and a communication line 47, in which the input unit 41, the memory 42, the operation unit 43, the hard disk 44, and the output unit 46 are connected to each other via the communication line 47 so that data etc. can be communicated among them and the hard disk 44 stores a database 45.

The input unit 41 has, for example, a data input device such as a keyboard not shown and so can output settings etc. to the operation unit 43 and is connected to the pressure sensor 7 and the boilers 21 through 25 with signal lines 13 and 16, to provide the operation unit 43 with a pressure signal supplied from the pressure sensor 7 and a signal (for example, information such as the combustion positions) supplied from the boilers 21 through 25.

The output unit 46 is connected to the boilers 21 through 25 with a signal line 14, to supply the boilers 21 through 25 with a control signal output from the operation unit 43.

The operation unit 43 reads a program stored in a storage medium (for example, ROM) of the memory 42 and executes it, for example, to calculate an evaporation quantity-corresponding to a desired load, decide whether the shift needs to be made to the combustion positions or the combustion stopped position about the boilers 21 through 25 based on information etc. about the operation states of the boilers supplied from the input unit 41, select the combustion positions or the combustion stopped position, decide whether the shift needs to be made to a steam supply shift process, and output a signal to the boilers 21 through 25 via the output unit 46 based on results of the decision.

The database 45 includes a first database 45A, in which a data table denoting a relationship between a pressure signal (mV) and a pressure (MPa) is stored as numeric data, so that the operation unit 43 references the first database 45A, to calculate the pressure (MPa) in the steam header 6 based on the pressure signal (mV) from the pressure sensor 7.

The program according to the first embodiment calculates the numbers of the presently operational (combustion shiftable) boilers and combustion positions, calculates a pressure deviation PD1 of a present time pressure PN (=Pmax−PN), divides the pressure deviation PD1 by a control pressure width (pressure control allowable width) P1 ((=P max−lowest allowable value of pressure), which is assumed to be the same irrespective of the number of the operating boilers) to calculate a ratio PR1 of the pressure deviation PD1 with respect to the control pressure width P1, multiplies the ratio PR1 and a number that corresponds to the operational combustion positions (in the present embodiment, (the number of the all combustion positions+1) is used as this number) to calculate the combustion subject boilers and the combustion positions, and provides the subject combustion positions with a combustion signal and a standby signal (combustion stop signal). Further, in the present embodiment, the combustion signal and the standby signal are arranged to be output to the combustion positions in accordance with preset priority sequence numbers of those positions.

Further, the combustion subject boilers and combustion positions are calculated, for example, as follows.

The number A of combustion positions to which a combustion instruction is output at the operational boiler, the number B of combustion positions required at the time of drop in pressure, and the number C of the combustion positions required at the time of rise in pressure are calculated as follows:

The number $B$ of combustion positions required at the time of drop in pressure={(maximum pressure $P$max in control pressure width−present time pressure $PN-K$)/(control pressure width $P1-K$)}×(2×the number of presently operational boilers n+1) Equation (1)

Next, the following is calculated:

The number $C$ of the combustion positions required at the time of rise in pressure=[{(maximum pressure $P$max in control pressure width−present time pressure $PN$)/(control pressure width $P1-K$)}×(2×the number of presently operational boilers $n$+1)]+1 Equation (2)

It is to be noted that the boilers 21 through 25 are each a three-position boiler and so each have two combustion positions, so that (number of combustion positions (=2)× number of presently operational boilers n) in Equations (1) and (2) denotes a total number of the operational combustion positions. In Equations (1) and (2), if each of the number B of combustion positions required at the time of drop in pressure and the number C of the combustion positions required at the time of rise in pressure is not an integer, its decimal fraction part is truncated.

It is to be noted that K in Equations (1) and (2) represents a constant related to the pressure and is zero or larger, so that by substituting the constant K into Equations (1) and (2), it is possible to provide a differential in a pressure be switched between the pressure rise time and the pressure drop time.

Subsequently, if the following relationship:

the number $A$ of combustion positions to which the combustion instruction is output<the number $B$ of combustion positions required at the time of drop in pressure Equation (3)

is established, the combustion signal is output to any one of the operational boilers, and if the following relationship:

the number $A$ of combustion positions to which the combustion instruction is output>the number $C$ of combustion positions required at the time of rise in pressure Equation (4)

is established, the standby signal is output to any one of the operational boilers, and if none of Equations, (3) and (4) is established, that is, if the number A of combustion positions to which the combustion instruction is output≥the number B of combustion positions required at the time of drop in pressure; and if the number A of combustion positions to which the combustion instruction is output≤the number C of combustion positions required at the time of rise in pressure, in other words, if the following relationship:

the number $C$ of combustion positions required at the time of rise in pressure≥the number $A$ of combustion positions to which the combustion instruction is output≥the number $B$ of combustion positions required at the time of drop in pressure Equation (5)

is established, the present combustion state is maintained.

In the present embodiment, K is set to 0 for easy explanation.

Figure 3:
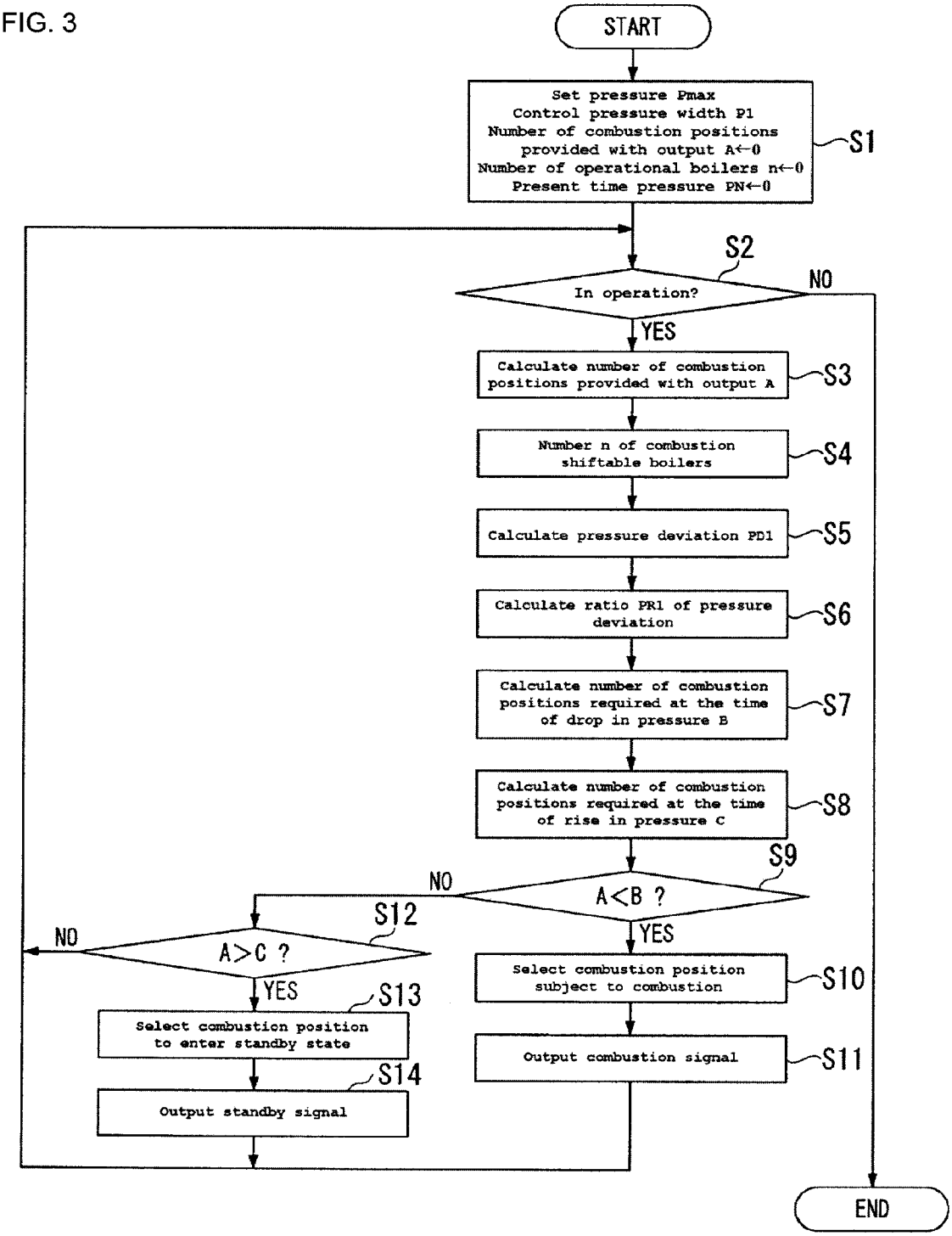
FIG. 3 is an explanatory flowchart of one example of a program according to the first embodiment.
Figure 4:
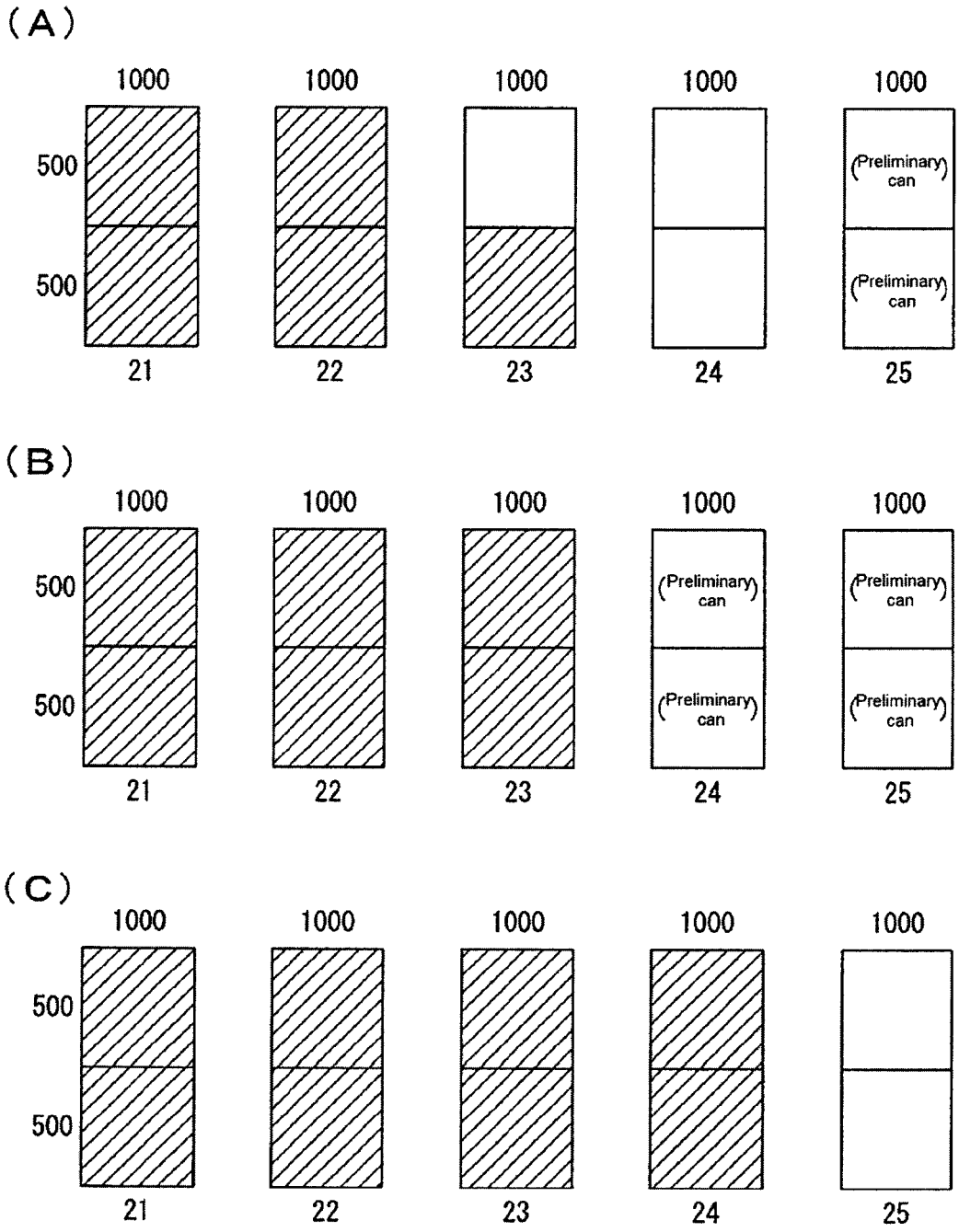
FIGS. 4A to 4C are explanatory views showing an outline of one example of operations of a boiler system according to the first embodiment.

The following will describe one example of the program according to the first embodiment with reference to a flowchart in FIG. 3. It is to be noted that in the flowchart in FIG. 3, Equations (1) and (2) (K=0) are used, and known combustion position control technologies are applicable to the shift of the combustion position or combustion stopped position based on the pressure signal from the pressure sensor 7 and, therefore, their explanation is omitted. Further, the boilers 21 through 25 are assigned preset priority sequence numbers related to combustion respectively.

(1) First, a set pressure Pmax and a control pressure width P1 are set, and an initial value (=0) is set to the number of combustion positions provided with the signal A, the number of operational boilers n, and the present time pressure PN respectively (S1).

(2) It is decided whether the boiler group 2 is in operation (S2).

If the boiler group 2 is in operation, the shift is made to step S3, and if it is not in operation, the program is ended.

(3) The operation unit 43 calculates the number of combustion positions provided with the combustion signal A based on, for example, data stored in the memory 42 (S3).

(4) The operation unit 43 calculates the number of operational boilers n based on the signal output from each of the boilers 21 through 25 and input by the input unit 41 (S9).

(5) The operation unit 43 acquires a present time pressure PN from the pressure sensor 7 via the input unit 41 and subtracts the maximum pressure Pmax from it to work out a pressure PN, thereby calculating a pressure deviation PD1 (S5).

(6) The operation unit 43 divides the pressure deviation PD1 calculated in step S5 by the control pressure width P1 to calculate a ratio PR1 of the pressure deviation PD1 with respect to the control pressure width P1 (S6).

(7) The operation unit 43 calculates the number B of combustion positions required at the time of drop in pressure by using Equation (1) (S7).

(8) The operation unit 43 calculates the number C of combustion positions required at the time of rise in pressure by using Equation (2) (S8).

(9) The operation unit 43 decides whether A<B is satisfied, thereby deciding whether the combustion quantity is to be increased (S9).

If A<B is satisfied, the shift is made to step S10, and if A<B is not satisfied, the shift is made to step S12.

(10) The operation unit 43 selects the combustion position subject to combustion in accordance with the priority sequence number (S10).

(11) The operation unit 43 outputs the combustion signal to the combustion position selected in step S10 (S11).

(12) The operation unit 43 decides whether A>C is satisfied, thereby deciding whether the combustion quantity is to be decreased (S12).

If A>C is satisfied, the shift is made to step S13, and if A>C is not satisfied, the shift is made to step S2.

(13) The operation unit 43 selects the combustion position to enter the standby state, in accordance with the priority sequence number (S13).

(14) The operation unit 43 outputs the standby signal to the combustion position selected in step S13 (S14).

Those steps of (2) through (14) are repeated, for example, once a second.

Next, a description will be given of actions of the boiler system 1 with reference to FIGS. 4A to 4C.

FIGS. 4A to 4C are illustrative views showing states of the combustion positions in which the boilers 21 through 25 are stabilized at the following present time pressures when control is conducted on the boiler group 2 by using the program, in which a square-shaped frame denotes the combustion states at the first combustion position and the second combustion position of the boilers 21 through 25, a numeral on its left side denotes the first differential evaporation quantity and the second differential evaporation quantity, and a numeral on the top of each of the frames denotes a rated evaporation quantity of each of the boilers.

Further, in FIGS. 4A to 4C, a hatched combustion position denotes the combustion position provided with a combustion output and a boiler written as a "(Preliminary can)" denotes the boiler not subject to operations.

Further, for ease of explanation, it is assumed that conditions such as the operational boilers, the preliminary cans, the set pressure Pmax, the control pressure width P1, and the present time pressure PN are the same in both FIGS. 4A, 4B, and 4C and FIGS. 9A, 9B, and 9C, so that a description will be given of a case where the first boiler 21, the second boiler 22, the third boiler 23, and the fourth boiler 24 are operational boilers and the fifth boiler 25 is a preliminary can. Further, the boilers 21 through 25 are assigned priority sequence numbers in this order so that if combustion is occurring at the first combustion position and yet to occur at the second combustion positions of each of the boilers 21 through 25, the combustion signal is output to the second combustion position before the shift is made to the next highest priority boiler.

Figure 9:
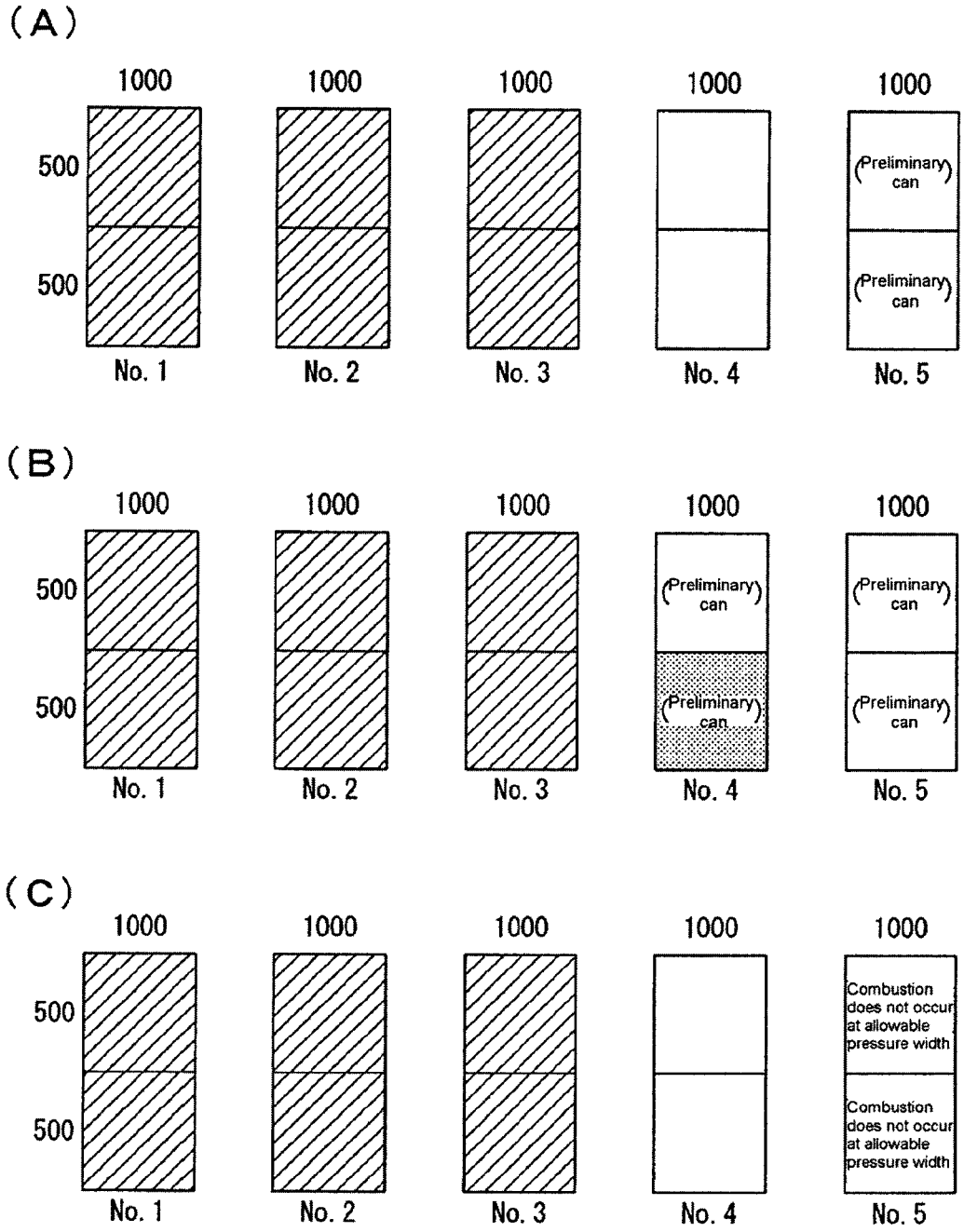
FIGS. 9A to 9C are explanatory views showing an outline of a conventional boiler system.

(1) First, similar to the case of FIG. 9A, a description will be given of a case where the present time pressure PN (=0.87 MPa) with respect to the set pressure Pmax (=1.0 MPa) and the control pressure width P1 (=0.2 MPa).

In this case, the boilers are stabilized in such a combustion state as shown in FIG. 4A. It is to be noted that numerals shown in (S3) are calculated using Equations (1) and (2) beforehand.

number of combustion positions provided with output A=5 (S3);

number of operational boilers n=4 (S4)

pressure deviation PD1=0.13 (MPa) (S5)

ratio of pressure deviation with respect to control pressure width PR1=0.65 (=(0.13)/(0.2)) (S6)

number of combustion positions required at the time of drop in pressure B=5 (decimal fraction part is truncated) (S7)

number of combustion positions required at the time of rise in pressure C=6 (decimal fraction part is truncated)(S8)

The decision in step S9 on whether the number A of combustion positions provided with output<the number B of combustion positions required at the time of drop in pressure results in negative ("NO") because the number A of combustion positions provided with output=the number B of combustion positions required at the time of drop in pressure (A=5 and B=5), so that the shift is made to step S12.

Further, the decision in step S12 on whether the number A of combustion positions provided with output>the number C of combustion positions required at the time of rise in pressure results in negative ("NO") because the number A (=5) of combustion positions provided with output<the number C (=6) of combustion positions required at the time of rise in pressure, so that the shift is made to step S2.

Accordingly, such a relationship is established as the number C of combustion positions required at the time of rise in pressure≥the number A of combustion positions to which the combustion instruction is output≥the number B of combustion positions required at the time of drop in pressure.

As a result, neither the combustion signal nor the standby signal is output, to maintain the five combustion positions as shown in FIG. 4A.

(2) Next, a description will be given of a case where the fourth boiler 24 provides a preliminary can under the conditions of the set pressure Pmax (=1.0 MPa), the control pressure width P1 (=0.2 MPa), and the present time pressure PN (=0.825 MPa).

Figure 8:
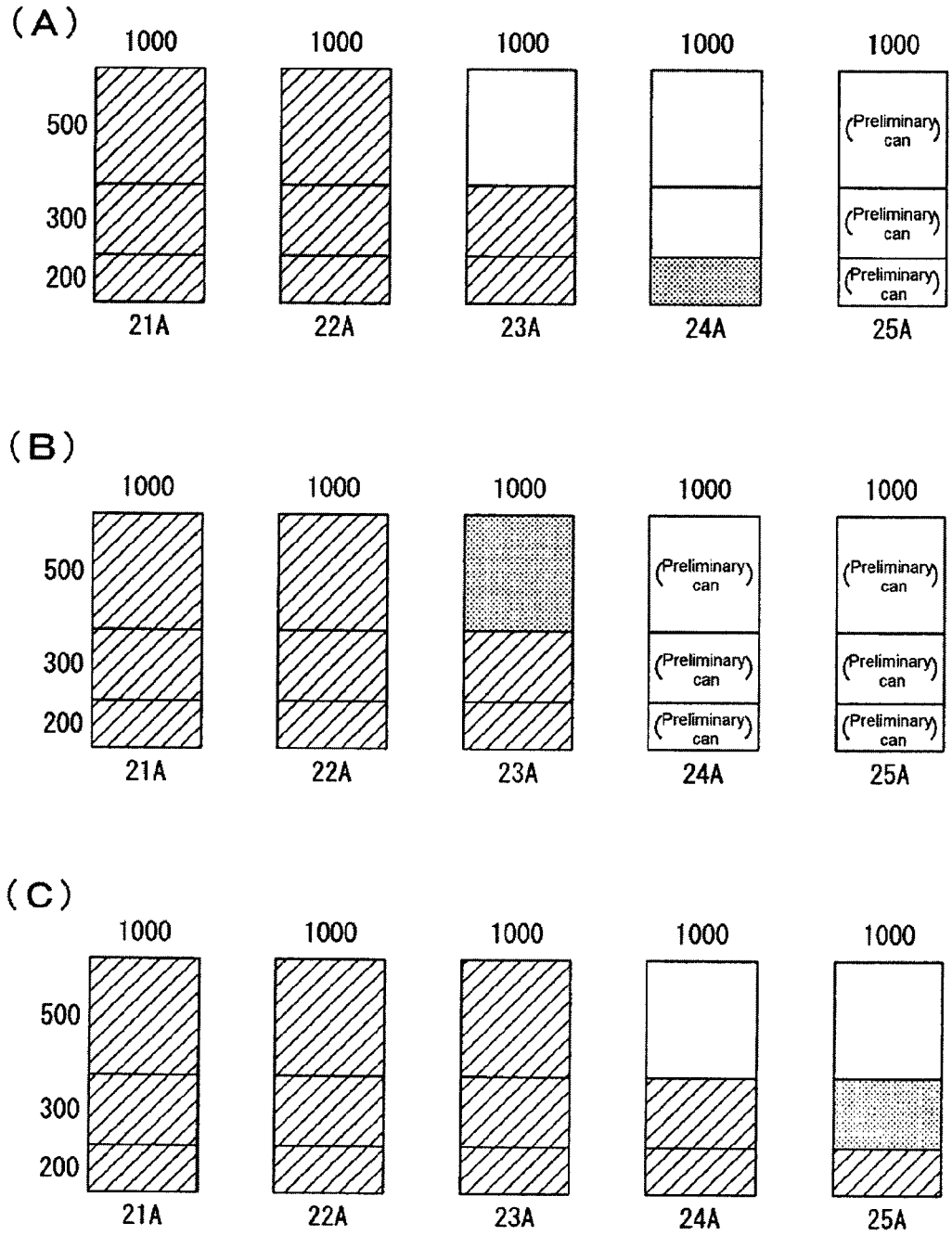
FIGS. 8A to 8C are explanatory views showing an outline of one example of operations of the boiler system according to the second embodiment.

In this case, the boilers are stabilized in such a combustion state as shown in FIG. 8C. It is to be noted that numerals denoted in (S3) are calculated using Equations (1) and (2) beforehand:

number of combustion positions provided with output A=6 (S3);

number of operational boilers n=3 (S4)

pressure deviation PD1=0.175 (MPa) (S5)

ratio of pressure deviation with respect to control pressure width PR1=0.875 (=(0.175)/(0.2)) (S6)

number of combustion positions required at the time of drop in pressure B=6 (decimal fraction part is truncated) (S7)

number of combustion positions required at the time of rise in pressure C=7 (decimal fraction part is truncated) (S8)

The decision in step S9 on whether the number A of combustion positions provided with output<the number B of combustion positions required at the time of drop in pressure results in negative ("NO") because the number A of combustion positions provided with output=the number B of combustion positions required at the time of drop in pressure (A=6 and B=6), so that the shift is made to step S12.

Further, the decision in step S12 on whether the number A of combustion positions provided with output>the number C of combustion positions required at the time of rise in pressure results in negative ("NO") because the number A (=6) of combustion positions provided with output<the number C (=7) of combustion positions required at the time of rise in pressure, so that the shift is made to step S2.

Accordingly, such a relationship is established as the number C of combustion positions required at the time of rise in pressure≥the number A of combustion positions to which the combustion instruction is output≥the number B of combustion positions required at the time of drop in pressure.

As a result, neither the combustion signal nor the standby signal is output, to maintain the six combustion positions as shown in FIG. 4B.

(3) Subsequently, a description will be given of a case where the fourth boiler 24 and the fifth boiler 25 are operational under the conditions of the set pressure Pmax (=1.0 MPa), the control pressure width P1 (=0.2 MPa), and the present time pressure PN (=0.85 MPa).

In this case, the boilers are stabilized in such a combustion state as shown in FIG. 8C. It is to be noted that the numerals denoted in (S3) are calculated using Equations (1) and (2) beforehand:

number of combustion positions provided with output A=8 (S3);

number of operational boilers n=5 (S4)

pressure deviation PD1=0.15 (NPa) (S5)

ratio of pressure deviation with respect to control pressure width PR1=0.75 (=(0.15)/(0.2)) (S6)

number of combustion positions required at the time of drop in pressure B=8 (decimal fraction part is truncated) (S7)

number of combustion positions required at the time of rise in pressure C=9 (decimal fraction part is truncated) (S8)

The decision in step S9 on whether the number A of combustion positions provided with output<the number B of combustion positions required at the time of drop in pressure results in negative ("NO") because the number A of combustion positions provided with output=the number B of combustion positions required at the time of drop in pressure (A=8 and B=8), so that the shift is made to step S12.

Further, the decision in step S12 on whether the number A of combustion positions provided with output>the number C of combustion positions required at the time of rise in pressure results in negative ("NO") because the number A (=8) of combustion positions provided with output<the number C (=9) of combustion positions required at the time of rise in pressure, so that the shift is made to step S2.

Accordingly, such a relationship is established as the number C of combustion positions required at the time of rise in pressure≥the number A of combustion positions to which the combustion instruction is output≥the number B of combustion positions required at the time of drop in pressure.

As a result, neither the combustion signal nor the standby signal is output, to maintain the eight combustion positions as shown in FIG. 4C.

In the boiler system 1, control is conducted on the entire range of the control pressure width P1 over the operational boilers and the combustion positions as a whole, so that the boiler group 2 can be operated efficiently.

As a result, the operational boilers (combustion positions) can each be allotted an appropriate pressure width so that appropriate control can be conducted.

Further, the boiler group 2 can be operated efficiently.

Further, the number of combustion positions subject to combustion can be calculated easily without detecting a rise or drop in pressure.

Further, in comparison to the case of controlling the subject boilers and combustion positions by patterns or the like, this approach facilitates setting and can reduce the storage capacity of the controller.

It is to be noted that the first embodiment may employ a configuration without differentials in switch pressure between the time of rise in pressure and the time of drop in pressure such that:

For example, in place of Equations (1) and (2), the following equations may be used:

the number $B$ of combustion positions required at the time of drop in pressure={(maximum pressure $P$max in control pressure width−present time pressure $PN$)/(control pressure width $P1$)}×(2× the number of presently operational boilers $n$) Equation (1A)

and

The number $C$ of the combustion positions required at the time of rise in pressure=[{(maximum pressure $P$max in control pressure width−present time pressure $PN$)/(control pressure width $P1$)}× (2×the number of presently operational boilers $n$] Equation (2A)

The following will describe a second embodiment of the present invention with reference to FIGS. 5 to 8C.

Figure 5:
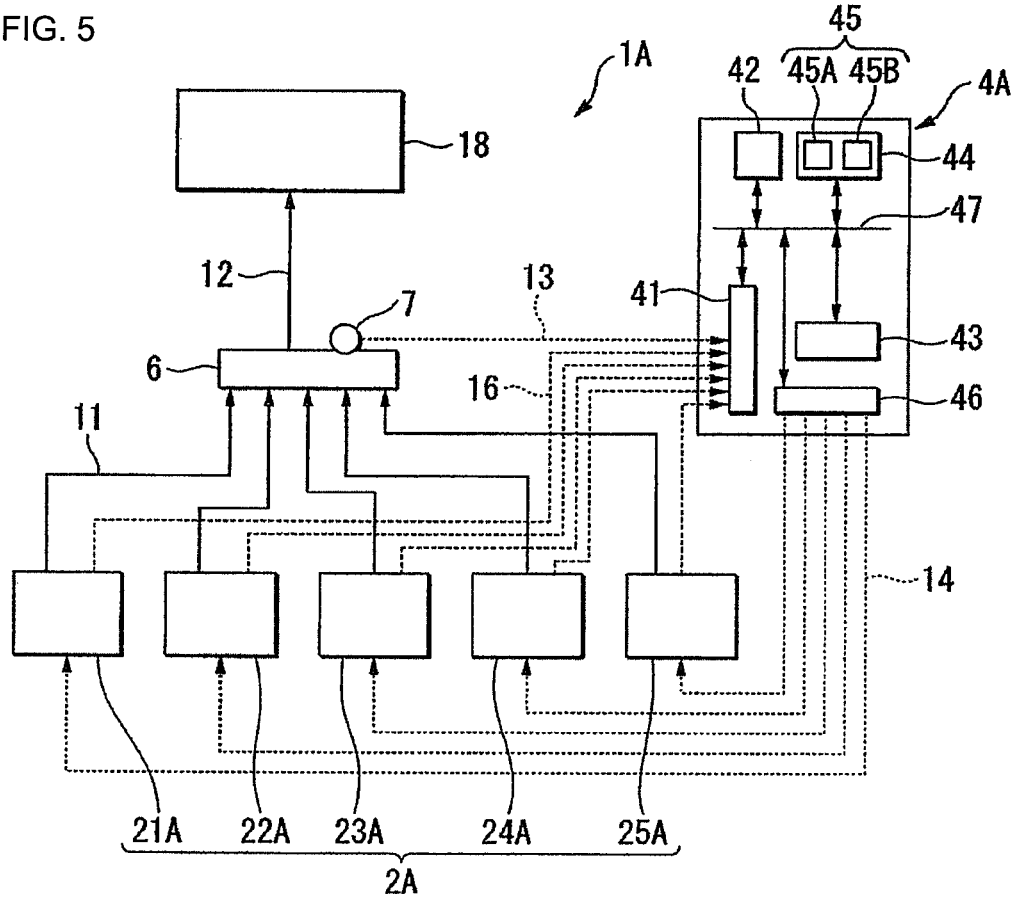
FIG. 5 is a diagram showing an outline of a boiler system according to a second embodiment of the present invention.

In FIG. 5, numeral 1A denotes a boiler system according to the second embodiment.

The boiler system 1A is different from the boiler system 1 in that the boiler group 2 and the control unit 4 are replaced with a boiler group 2A and a control unit 4A respectively. The other components are the same as those in the first embodiment, so that identical reference numerals are given to identical components in them, and description thereof will not be repeated here.

The boiler group 2A includes, for example, five steam boilers of a first boiler 21A, a second boiler 22A, a third boiler 23A, a fourth boiler 24A, and a fifth boiler 25A.

Figure 6:
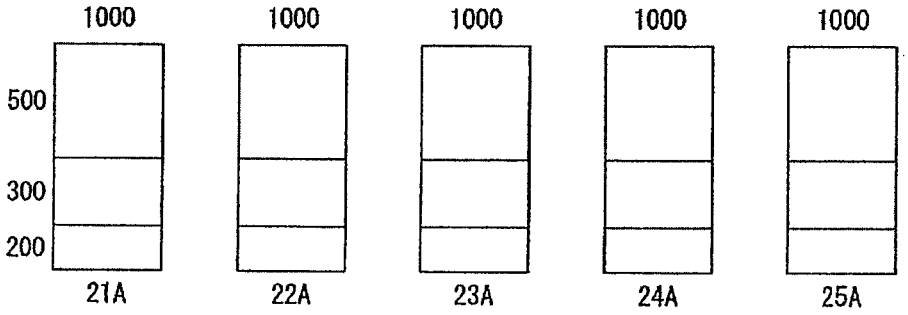
FIG. 6 is an explanatory outline of one example of operations of a boiler system according to the second embodiment.

The boilers 21A through 25A of the boiler group 2A are each, for example, a four-position control boiler as shown in FIG. 6 and can be controlled in combustion in a combustion stopped state (which corresponds to a combustion stopped position), a low combustion state assumed to be a bottom combustion position (which corresponds to a first combustion position), an intermediate combustion state (which corresponds to a second combustion position), and a high combustion state (which corresponds to a third combustion position) and also have a first differential evaporation quantity of 200 (kg/h), a second differential evaporation quantity of 300 (kg/h), and a third differential evaporation quantity of 500 (kg/h), a rated evaporation quantity being 1000 (kg/h).

The boilers 21A through 25A are arranged to notify the control unit 4A of whether the boilers and their respective combustion positions are combustion shiftable.

In the control unit 4A, a database 45 stored in a hard disk 44 includes a first database 45A and a second database 45B: the first database 45A has the same configuration as that in the first embodiment and the second database 45B stores, for example, the first evaporation quantity, the second evaporation quantity, the third evaporation quantity, and rated evaporation quantity of the boilers 21A through 25A in the format of a data table, so that the operation unit 43 can reference the second database 45B to calculate a total evaporation quantity at the combustion positions provided with a combustion signal (hereinafter referred to as total evaporation quantity) JT and a gross evaporation quantity at the presently operational (combustion shiftable) combustion positions (hereinafter referred to as gross evaporation quantity) JG.

A program according to the second embodiment calculates a gross evaporation quantity JG and a total evaporation quantity JT to calculate a pressure deviation PD2 of a present time pressure PN (Pmax−PN) and divides the pressure deviation PD2 by a control pressure width P2, thereby calculating a ratio PR2 of the pressure deviation PD2 with respect to the control pressure width P2.

Further, the program multiplies the ratio PR2 and the gross evaporation quantity JG to calculate a required evaporation quantity JN and selects combustion subject boilers and their combustion positions to output the combustion signal and the standby signal to the selected combustion positions.

Further, in the present embodiment, the combustion positions are provided with the combustion signal and the standby signal in accordance with their preset priority sequence numbers.

Further, the combustion subject boilers and their combustion positions are calculated as follows, for example:

A required evaporation quantity JN and a total evaporation quantity JT are compared to each other.

At the time of drop in pressure, if the following relationship is established:

Required evaporation quantity $JN$>total evaporation quantity $JT$ Equation (11)

the combustion signal is output to the combustion position that corresponds to an evaporation quantity of (required evaporation quantity JN−total evaporation quantity JT); and at the time of rise in pressure, if the following relationship is established:

Required evaporation quantity $JN$<total evaporation quantity $JT$ Equation (12)

the standby signal is output to the combustion position that corresponds to an evaporation quantity of (total evaporation quantity JT−required evaporation quantity JN).

Figure 7:
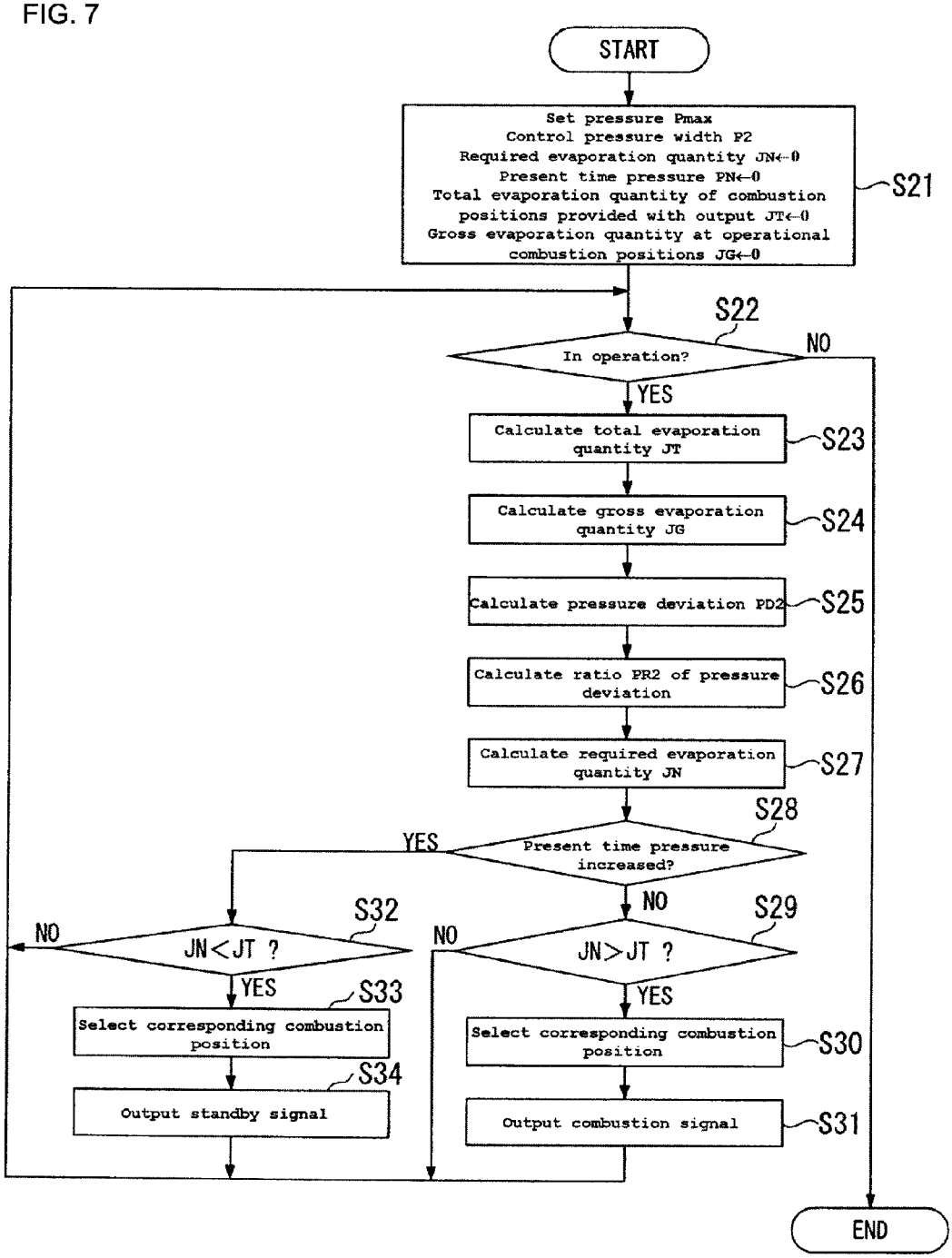
FIG. 7 is an explanatory flowchart of one example of a program according to the second embodiment.

The following will describe one example of the program according to the second embodiment with reference to a flowchart in FIG. 7. It is to be noted that in the flowchart in FIG. 7, Equations (11) and (12) are used, and known combustion position control technologies are applicable to the shift of the combustion position or combustion stopped position based on the pressure signal from the pressure sensor 7 and, therefore, their explanation is omitted. Further, the boilers 21A through 25A are assigned preset priority sequence numbers related to combustion respectively, so that no differentials are given to them for ease of explanation.

(1) First, a set pressure Pmax and a control pressure width P are set, and an initial value (=0) is set to the present time pressure PN, the required evaporation quantity JN, the total evaporation quantity JT at combustion positions provided with an output, and the gross evaporation quantity JG at the combustion shiftable combustion positions (S21).

(2) It is decided whether the boiler group 2 is in operation (S22).

If the boiler group 2 is in operation, the shift is made to step S23, and if it is not in operation, the program is ended.

(3) The operation unit 43 calculates the total evaporation quantity JT based on, for example, data stored in a memory 42 (S23).

(4) The operation unit 43 calculates the gross evaporation quantity JG based on a signal output from each of the boilers 21 through 25 and input by the input unit 41 (S29).

(5) The operation unit 43 acquires a present time pressure PN from the pressure sensor 7 via the input unit 41 and performs subtraction (Pmax−PN), thereby calculating a pressure deviation PD2 (S25).

(6) The operation unit 43 divides the pressure deviation PD2 calculated in step S25 by the control pressure width P2 to calculate a ratio PR2 of the pressure deviation PD2 with respect to the control pressure width P2 (S26).

(7) The operation unit 43 calculates the required evaporation quantity JN (S27).

(8) The operation unit 43 compares a previously measured present-time pressure stored in the memory 42 and the presently measured present-time pressure PN to decide whether the present time pressure PN has been increased (S28).

If the present time pressure PN is yet to be increased, the shift is made to step S29, and if it has been increased, the shift is made to step S32.

(9) The operation unit 43 decides whether the required evaporation quantity JN>the total evaporation quantity JT is established owing to a drop in present time pressure PN (S29).

If the required evaporation quantity JN>the total evaporation quantity JT is established, it is decided that the combustion quantity is insufficient, and the shift is made to step S30, and if the required evaporation quantity JN>the total evaporation quantity JT is not established, the shift is made to step S22.

(10) The operation unit 43 selects one of the combustion shiftable combustion positions that is closest to (the required evaporation quantity JN−total evaporation quantity JT) and, after the shift, satisfies the required evaporation quantity JN≤the total evaporation quantity JT (S30).

If there are a plurality of combustion positions that are combustion shiftable and have the same gross of the differential evaporation quantities, the combustion position subject to combustion is selected in accordance with the priority sequence number.

(11) The operation unit 43 outputs the combustion signal to the combustion position selected in step S30 (S31). After the combustion signal is output, the shift is made to step S22.

(12) The operation unit 43 decides whether the required evaporation quantity JN<the total evaporation quantity of the combustion positions provided with the output JT is established owing to a rise in present time pressure PN (S32).

If the required evaporation quantity JN<the total evaporation quantity JT is established, the shift is made to step S33, and if the required evaporation quantity JN<the total evaporation quantity of the combustion positions provided with the output JT is not established, the shift is made to step S22.

(13) The operation unit 43 selects one of the combustion positions shiftable to the standby state that is closest to (total evaporation quantity JT−the required evaporation quantity JN) and, after the shift, satisfies the required evaporation quantity JN≥the total evaporation quantity JT.

If there are a plurality of combustion positions that are shiftable to the standby state and have the same gross of the differential evaporation quantities, the combustion position to enter the standby state is selected in accordance with the priority sequence number (S33).

(14) The operation unit 43 outputs the standby signal to the combustion position selected in step S33 (S34).

Those steps of (2) through (14) are repeated, for example, once per one to three seconds.

Next, a description will be given of actions of the boiler system 1A with reference to FIGS. 8A to 8C.

FIGS. 8A to 8C are illustrative views showing states of the combustion positions in which the boilers 21A through 25A are stabilized at the following present time pressures when control is conducted on the boiler group 2 by using the program according to the second embodiment, in which a square-shaped frame denotes the combustion states at the first combustion position through the third combustion position of the boilers 21A through 25A, a numeral on its left side denotes the first differential evaporation quantity through the third differential evaporation quantity, and a numeral on the top of each of the frames denotes a rated evaporation quantity of each of the boilers.

Further, in FIGS. 8A to 8C, a hatched combustion position denotes the combustion position provided with a combustion output and a boiler written as a "(Preliminary can)" denotes the boiler not subject to operations. Further, a shaded combustion position denotes the combustion position on which whether the combustion output is provided is to be selected based on whether the present time pressure PN is at the time of rise or drop.

Further, for ease of explanation, it is assumed that conditions such as the operational boilers, the preliminary cans, the set pressure Pmax, the control pressure width P1, and the present time pressure PN are the same in both FIGS. 8A, 8B, and 8C and FIGS. 9A, 9B, and 9C, so that a description will be given of a case where the first boiler 21A, the second boiler 22A, the third boiler 23A, and the fourth boiler 24A are operational boilers and the fifth boiler 25A is a preliminary can. Further, among the combustion shiftable combustion positions of each of the boilers 21A through 25A of the boiler group 2A, the combustion position whose differential evaporation quantity is closest to the required evaporation quantity is subject to a combustion shift in priority to the others, and if there are a plurality of such combustion positions, the priority is given to the boilers 21A through 25A in accordance with their priority sequence numbers which are set in this order.

(1) First, similar to the case of FIG. 9A, a description will be given of a case where the present time pressure PN (=0.87 MPa) with respect to the set pressure Pmax (=1.0 MPa) and the control pressure width P2 (=0.2 MPa).

In this case, the boilers are stabilized in such a combustion state as shown in FIG. 8A. In a case where:

gross evaporation quantity at the shiftable combustion positions JG=4000 (kg/h) (S24), pressure deviation PD2=0.13 (MPa) (S25), ratio of pressure deviation with respect to control pressure width PR2=0.65 (=(0.13)/(0.2)) (S26), and required evaporation quantity JN=JG (=4000)×pressure deviation ratio PR2 (=0.65)=2600 (kg/h) (S27), the total evaporation quantity JT calculated in step S23 in stabilization of the combustion state is provided with the combustion signal until the required evaporation quantity JN (=2600 (kg/h))≤the total evaporation quantity JT is satisfied at the time of drop in present time pressure PN and, at the time of rise in present time pressure PN, provided with the standby signal until the required evaporation quantity JN (=2600 (kg/h))≥the total evaporation quantity JT is satisfied.

Therefore, at the time of drop in present time pressure PN, the combustion signal is output to the combustion position that provides a combustion position (where the total evaporation quantity JT is 2700 (kg/h)) denoted by a hatched or shaded frame in FIG. 8A at which the total evaporation quantity JT becomes equal to or more than the required evaporation quantity JN (=2600 (kg/h)), and at the time of rise in present time pressure PN, the combustion signal is output to the combustion position (where the total evaporation quantity JTJT (=2500 (kg/h)) denoted by a hatched frame in FIG. 8A at which the total evaporation quantity JT becomes equal to or less than the required evaporation quantity JN (=2600 (kg/h)).

(2) Next, a description will be given of a case where the fourth boiler 24A provides a preliminary can under the conditions of the set pressure Pmax (=1.0 MPa), the control pressure width (=0.2 MPa), and the present time pressure PN (=0.825 MPa).

In this case, the boilers are stabilized in such a combustion state as shown in FIG. 8B. In a case where:

gross evaporation quantity at the shiftable combustion positions JG=3000 (kg/h) (S24), pressure deviation PD2=0.175 (MPa) (S25), ratio of pressure deviation with respect to control pressure width PR2=0.875 (=(0.175)/(0.2)) (S26), and required evaporation quantity JN=JG (=3000)×pressure deviation ratio PR2 (=0.875)=2625 (kg/h) (S27), the total evaporation quantity JT calculated in step S23 in stabilization of the combustion state is provided with the combustion signal until the required evaporation quantity JN (=2625 (kg/h))≤the total evaporation quantity JT is satisfied at the time of drop in present time pressure PN and, at the time of rise in present time pressure PN, provided with the standby signal until the required evaporation quantity JN (=2625 (kg/h))≥the total evaporation quantity JT is satisfied.

Therefore, at the time of drop in present time pressure PN, the combustion signal is output to the combustion position that provides a combustion position (whose total evaporation quantity JT is 3000 (kg/h)) denoted by a hatched or shaded frame in FIG. 88 at which the total evaporation quantity JT becomes equal to or more than the required evaporation quantity JN (=2625 (kg/h)), and at the time of rise in present time pressure PN, the combustion signal is output to the combustion position (where the total evaporation quantity JT (=2500 (kg/h)) denoted by a hatched frame in FIG. 8B at which the total evaporation quantity JT becomes equal to or less than the required evaporation quantity JN (=2625 (kg/h)).

(3) Next, a description will be given of a case where the fourth boiler 24A and the fifth boiler 25A, become operational under the conditions of the set pressure Pmax (=1.0 MPa), the control pressure width P2 (=0.2 MPa), and the present time pressure PN (=0.85 MPa).

In this case, the boilers are stabilized in such a combustion state as shown in FIG. 8C. In a case where:

gross evaporation quantity at the shiftable combustion positions JG=5000 (kg/h) (S24), pressure deviation PD2=0.15 (MPa) (S25), ratio of pressure deviation with respect to control pressure width PR2=0.75 (=(0.15)/(0.2)) (S26), and required evaporation quantity JN=JG (=5000)×pressure deviation ratio (=0.75)=3750 (kg/h) (S27), the total evaporation quantity JT calculated in step S23 in stabilization of the combustion state is provided with the combustion signal until the required evaporation quantity JN (=3750 (kg/h))≤the total evaporation quantity JT is satisfied at the time of drop in present time pressure PN and, at the time of rise in present time pressure PN, provided with the standby signal until the required evaporation quantity JN (=3750 (kg/h))≥the total evaporation quantity JT is satisfied.

Therefore, at the time of drop in present time pressure PN, the combustion signal is output to the combustion position that provides a combustion position (whose total evaporation quantity JT is 4000 (kg/h)) denoted by a hatched or shaded frame in FIG. 8C at which the total evaporation quantity JT becomes equal to or more than the required evaporation quantity JN (—3750 (kg/h)), and at the time of rise in present time pressure PN, the combustion signal is output to the combustion position (where the total evaporation quantity JT (=3700 (kg/h)) denoted by a hatched frame in FIG. 8C at which the total evaporation quantity JT becomes equal to or less than the required evaporation quantity JN (=3750 (kg/h)).

In accordance with the boiler system 1A, the control pressure width can be controlled over all of the operational boilers. As a result, the boiler group 2A can be operated efficiently.

In accordance with the boiler system 1A, the combustion signal or the standby signal is output to a combustion position whose differential evaporation quantity is (the required evaporation quantity JN−the present time total evaporation quantity JT), so that the required evaporation quantity JN can be secured easily. As a result, the boiler group 2A can be operated efficiently.

Resultantly, efficient and appropriate operations can be performed even in the boilers having different differential evaporation quantities at each of the combustion positions, for example, the boilers where the first differential evaporation quantity vs. second differential evaporation quantity is not 1:1.

It is to be noted that the present invention is not limited the aforementioned embodiments and, accordingly, any and all modifications should be considered to be within the scope of the present invention without departing the gist of the present invention.

For example, although the aforementioned embodiment has been described with reference to the case of constituting the boiler group 2 of five three-position control boilers and constituting the boiler group 2A of five four-position control boilers, it is possible to arbitrarily set the configurations of the boilers of each of the boiler groups 2 and 2A and the number of the boilers. For example, the boiler having four positions or more may be used and the boilers having the different numbers of combustion positions and evaporation quantities etc. may be combined.

Further, although the aforementioned embodiments have been described with reference to the case where the physical quantity has been a pressure, the pressure may be replaced with any other physical quantities, for example, the temperature of water or a steam flow to control the boiler groups 2 and 2A based on it.

Further, although the aforementioned embodiments have been described with reference to the case where the combustion signal and the standby signal have been output if the boiler groups 2 and 2A have satisfied or have not satisfied the predetermined inequality signs, any other calculation methods may be used, or in the case of selecting a boiler and a combustion position to be provided with the combustion or standby signal, it may be possible to select the boiler and the combustion position to make the shift to the combustion state or the standby state by setting a predetermined range. Further, not limited to multiplication by the number of the operational boilers or the number of combustion positions, it is possible to use a correction value or a correction function as in the case of Equations (1) and (2).

Further, although the aforementioned second embodiments have been described with reference to the case of providing no differentials in the band of the control pressure at the time of rise and drop in pressure, a differential may be provided in the band of the control pressure at the time of rise and drop in pressure.

Further, although the first and second embodiments have been described with reference to the case of selecting combustion positions or combustion stopped positions of each of the boilers 21 through 25 (boilers 21A, through 25A) so that the gross evaporation quantity JR satisfying the required evaporation quantity JN of the boiler group 2 might be secured and providing them with the combustion or standby signal, for example, the combustion positions or the combustion stopped positions may be selected so that the gross evaporation quantity JR may be less than the required evaporation quantity JN or may fall in a predetermined range of the required evaporation quantity JN.

Further, it is possible to arbitrarily set so whether to calculate the required evaporation quantity JN by using a single equation or a plurality of equations corresponding to the time of rise and drop in pressure respectively.

Further, although one example of the outlined configuration of the programs according to the aforementioned embodiments has been shows in FIGS. 3 and 7 as a flowchart, of course, any other methods (algorithm) than the flowchart may be used to configure the program.

Further, although the embodiments have been described with reference to the case of using an ROM as the recording medium configured to store the program, any other medium other than the ROM may be used such as an EP-ROM, hard disk, flexible disk, optical disk, magneto-optical disk, CD-ROM, CD-R, magnetic tape, or nonvolatile memory card. Further, when the read program is executed by the operation unit, not only the actions of the aforementioned embodiment are realized but also the operating system (OS) working in the operation unit performs part or all of actual processing based on instructions of the program, which processing may realize the actions of the embodiments in some cases. Moreover, such a case may be possible in which the program read from the storage medium is written into a memory equipped to a function enhancement board inserted to the operation unit or a function enhancement unit connected to the operation unit so that subsequently, based on the instructions of this program, the CPU etc. equipped to this function enhancement board or function enhancement unit may perform part or all of the actual processing, which processing may realize the actions of the embodiments.

By changing the control width when outputting the combustion and standby signals to each of combustion positions corresponding to the respective numbers of combustion shiftable boilers and combustion positions, the boiler group can be operated efficiently.

What is claimed is:

1. A non-transitory storage medium storing a program which, when executed by a controller, causes the controller to control a boiler group including boilers each of which has a plurality of stepwise combustion positions, the program comprising:

calculating a number of presently combustion shiftable boilers, a number of their combustion positions, or a gross evaporation quantity;

calculating a deviation quantity between a set physical quantity and a present time physical quantity;

calculating a ratio between the deviation quantity and a control width that corresponds to the set physical quantity;

calculating combustion subject boilers and their combustion positions based on the number of the combustion shiftable boilers, the number of their combustion positions, or the gross evaporation quantity and the ratio;

calculating the number of the presently combustion shiftable boilers and the number of their combustion positions;

calculating a pressure deviation between a set pressure and a present time pressure;

calculating a ratio of the pressure deviation with respect to a pressure control allowable width by dividing the pressure deviation by the pressure control allowable width; and calculating the combustion subject boilers and their combustion positions by multiplying the ratio and the number of combustion shiftable positions.

2. The non-transitory storage medium storing the program of claim 1, wherein the program further comprising:

calculating the number of the combustion positions of the operational boilers to which positions a combustion instruction is output, the number of the combustion positions required at a time of drop in pressure, and the number of the combustion positions required at a time of rise in pressure;

when the combustion positions to which the combustion instruction is output is smaller than the number of combustion positions required at the time of drop in pressure, outputting a combustion signal to the combustion position of any one of the operational boilers;

when the combustion positions to which the combustion instruction is output is larger than the number of combustion positions required at the time of rise in pressure, outputting a standby signal to the combustion position of any one of the operational boilers; and when the number of combustion positions required at the time of rise in pressure is equal to or larger than the number of the combustion positions to which the combustion instruction is output, and the number of the combustion positions to which the combustion instruction is output is equal to or larger than the number of combustion positions required at the time of drop in pressure, maintaining the present combustion state.

3. A controller for controlling a boiler group comprising the non-transitory storage medium storing the program of claim 2, an input unit for inputting the inputted information signals to an operation unit, an operation unit for reading the inputted information signals, executing the program stored in the non-transitory storage medium, and preparing outgoing information signals based on calculations made by the program, an output unit for outputting the information signals from the operations unit to each boiler, and a communication line that connects the input unit, the operation unit and the output unit to each other, and to a boiler group.

4. A boiler system comprising the controller for controlling the boiler group of claim 3 and a boiler group comprising at least two boilers.

5. A controller for controlling a boiler group comprising the non-transitory storage medium storing the program of claim 1, an input unit for inputting the inputted information signals to an operation unit, an operation unit for reading the inputted information signals, executing the program stored in the non-transitory storage medium, and preparing outgoing information signals based on calculations made by the program, an output unit for outputting the information signals from the operations unit to each boiler, and a communication line that connects the input unit, the operation unit and the output unit to each other, and to a boiler group.

6. A boiler system comprising the controller for controlling the boiler group of claim 5 and a boiler group comprising at least two boilers.

7. A non-transitory storage medium storing a program which, when executed by a controller, causes the controller to control a boiler group including boilers each of which has a plurality of stepwise combustion positions, the program comprising:

calculating a number of presently combustion shiftable boilers, a number of their combustion positions, or a gross evaporation quantity:

calculating a deviation quantity between a set physical quantity and a present time physical quantity;

calculating a ratio between the deviation quantity and a control width that corresponds to the set physical quantity;

calculating combustion subject boilers and their combustion positions based on the number of the combustion shiftable boilers, the number of their combustion positions, or the gross evaporation quantity and the ratio;

calculating the gross evaporation quantity at the combustion positions that can shift in combustion at the present time calculating a pressure deviation between a set pressure and a present time pressure;

calculating a ratio of the pressure deviation with respect to a pressure control allowable width by dividing the pressure deviation by the pressure control allowable width;

calculating a required evaporation quantity by multiplying, the ratio and the gross evaporation quantity; and calculating the boilers subject to combustion and their combustion positions.

8. The non-transitory storage medium storing the program of claim 7, wherein the program further comprising:

comparing the required evaporation quantity and the gross evaporation quantity at the combustion positions to which the combustion instruction is output;

when the required evaporation quantity is larger than the gross evaporation quantity at the combustion positions to which the combustion instruction is output at the time of drop in pressure, the combustion signal is output to the combustion position that corresponds to the evaporation quantity of the required evaporation quantity subtracted by the gross evaporation quantity at the combustion positions to which the combustion instruction is output; and when the required evaporation quantity is smaller the gross evaporation quantity at the combustion positions to which the combustion instruction is output at the time of rise in pressure, the standby signal is output to the combustion position that corresponds to the evaporation quantity of the gross evaporation quantity at the combustion positions to which the combustion instruction is output subtracted by the required evaporation quantity).

9. A controller for controlling a boiler group comprising the non-transitory storage medium storing the program of claim 8, an input unit for inputting the inputted information signals to an operation unit, an operation unit for reading the inputted information signals, executing the program stored in the non-transitory storage medium, and preparing outgoing information signals based on calculations made by the program, an output unit for outputting the information signals from the operations unit to each boiler, and a communication line that connects the input unit, the operation unit and the output unit to each other, and to a boiler group.

10. A boiler system comprising the controller for controlling the boiler group of claim 9 and a boiler group comprising at least two boilers.

11. A controller for controlling a boiler group comprising the non-transitory storage medium storing the program of claim 7, an input unit for inputting the inputted information signals to an operation unit, an operation unit for reading the inputted information signals, executing the program stored in the non-transitory storage medium, and preparing outgoing information signals based on calculations made by the program, an output unit for outputting the information signals from the operations unit to each boiler, and a communication line that connects the input unit, the operation unit and the output unit to each other, and to a boiler group.

12. A boiler system comprising the controller for controlling the boiler group of claim 11 and a boiler group comprising at least two boilers.

* * * * *